United States Patent [19]

Green et al.

[11] Patent Number: 4,994,709

[45] Date of Patent: Feb. 19, 1991

[54] METHOD FOR MAKING A CATHADER WITH INTEGRAL SHADOW GRID

[75] Inventors: Michael C. Green, Palo Alto; George V. Miram, Atherton, both of Calif.

[73] Assignee: Varian Associates, Inc., Palo Alto, Calif.

[21] Appl. No.: 327,222

[22] Filed: Mar. 22, 1989

[51] Int. Cl.[5] ..... H01J 1/20; H01J 9/04; H01J 9/14

[52] U.S. Cl. ..... 313/310; 313/299; 313/338; 313/411; 313/447; 156/631; 156/632; 427/78; 445/50; 445/51

[58] Field of Search ..... 313/293, 299, 304, 310, 313/338, 411, 447, 452, 454; 156/630, 631, 632, 643; 427/77, 78; 445/49, 50, 51

[56] References Cited

U.S. PATENT DOCUMENTS 3,967,150 6/1976 Lien et al. ..... 313/338
4,745,326 5/1988 Greene et al. ..... 313/293 X

*Primary Examiner*—Kenneth Wieder
*Attorney, Agent, or Firm*—Stanley Z. Cole; Peter J. Sgarbossa; Sheri M. Novack

[57] ABSTRACT

A very fine-mesh, non-emissive shadow grid is formed on the smooth emissive surface 16 of a thermionic cathode 12 by deposition from a vapor a continuous layer 22 of non-emissive conductive material. Between the elements 24 of the grid the non-emissive material is removed by bombardment through an apertured mask to restore emissivity between the elevated grid elements 24.

6 Claims, 2 Drawing Sheets

10
12
14
16
18
20
22
24
26
28

METHOD FOR MAKING A CATHADER WITH INTEGRAL SHADOW GRID

FIELD OF THE INVENTION

The invention pertains to guns for linear-beam electron tubes. The "shadow grid" is a perforated electrode element near the emitting cathode which is itself non-emitting and covers areas of the cathode lying behind the perforated control grid conductive members to guide the current into paths passing through the apertures in the control grid without striking the conductive members.

PRIOR ART

In a grid-controlled electron gun a problem is grid bombardment by emitted electrons. This has been reduced by electron-optically shaping the cathode surface to focus the electrons between and through the grid elements.

U.S. Pat. No. 3,558,967 issued Jan. 26, 1971 to G. V. Miram discloses a "golf ball" cathode having concave dimples to direct electrons through holes in the grid mesh. (Prior work had used cylindrical grooves for parallel-wire grids.) This reduced interception markedly, but there was still emission of electrons from the ridges or flats between grooves which reach the grid bars.

Another approach was to overlay portions of the cathode surface beneath the control-grid elements with a "shadow grid" which was non-emitting either by virtue of temperature lower than the cathode's or by making it of non-emissive material. The shadow-grid surface was elevated above the emissive surface to provide electron-optical focusing of "beamlets" between control-grid conductors. When the shadow grid was a separate unit above the surface of the cathode or lying directly on it, its differential thermal expansion provoked a problem of maintaining proper focus. U.S. Pat. No. 3,967,150 issued June 29, 1976 to Erling L. Lien, George V. Miram and Richard B. Nelson discloses an integral shadow grid formed of non-emissive material as an integral part of the surface of a golf-ball cathode. In this embodiment, the shadow-grid and cathode dimples are formed by mechanical machining. This is expensive and limits the fineness of the grid mesh. The mesh size must be small in guns forming the tiny beams needed for microwave tubes generating very short wavelength.

Another embodiment of '150 involves depositing mechanically removable material through a mask to cover areas intended to be emissive, depositing non-emissive material in the masked-off areas and removing the (powdered) material from the emissive areas. This avoids the machining limitation, but the mesh size is still limited by the mechanical operation.

The present invention comprises a method of producing a bonded shadow grid of very small dimensions by atomic or optical procedures.

SUMMARY OF THE INVENTION

An object of the invention is to provide a gun with a shadow grid very close to the cathode.

A further object is to provide a shadow grid of very fine structure.

A further object is to provide a shadow grid that is immovable with respect to the cathode.

A further object is to provide a unitized cathode and shadow grid structure which is easily manufacturable to very close tolerances.

These objects are realized by forming the shadow grid as an integral part of the cathode structure which is deposited on the cathode and machined by bombardment to very close tolerances and very fine structure.

DESCRIPTION OF THE PREFERRED EMBODIMENTS

In electron discharge devices using extended, smooth thermionic emission cathodes an apertured control grid is often spaced in front of the emissive surface for applying potentials to control the emitted current. A principal drawback is that the grid often must have a positive bias to draw the required current. This causes the grid to draw electrons directly to the grid wire or bar elements. The grid then emits undesirable secondary electrons. Also, the grid is heated, resulting in expansion movements and in severe cases to thermionic grid emission and even melting of the grid.

These problems are most severe in linear-beam tubes where the electrons are converged and focused through a small anode hole. The local electric fields around the grid elements diffract the electron paths causing the beam to spread and be intercepted on the downstream interaction circuits.

As described under "prior art" a partial solution was to place a "shadow" grid very near or actually on the cathode surface with elements directly behind the control-grid elements. The shadow grid is designed to be non-emissive due to either a reduced temperature or to an emission-suppressing chemical surface. The shadow grid, by extending above the cathode surface, also provides local electric field directing electrons emitted near the shadow grid away from it so they are guided by electron optics through the control-grid apertures.

To make the control grid spatially stable, it has proved advantageous to bond it directly to the cathode. The invention covers an improved way to do this.

High amplification factor and electron-optical convergence of the entire beam require a very fine-mesh grid, so that manufacture by machining methods becomes impractical for acceptable accuracy and cost. The grid cannot be made thinner than about 0.002" by conventional fabrication techniques. This excessive thickness overconverges the electron beamlets and degrades the focussing. It also increases the electrical noise level in the tube, which is a key performance parameter in many applications. The invention on the other hand provides an extremely fine-grained, accurate structure which can be made as a single unit or even as many units simultaneously.

FIGS. 1-6 illustrate the steps in the process, which is important for the final structure.

Figures 1, 2, 3, 4, 5, 6:
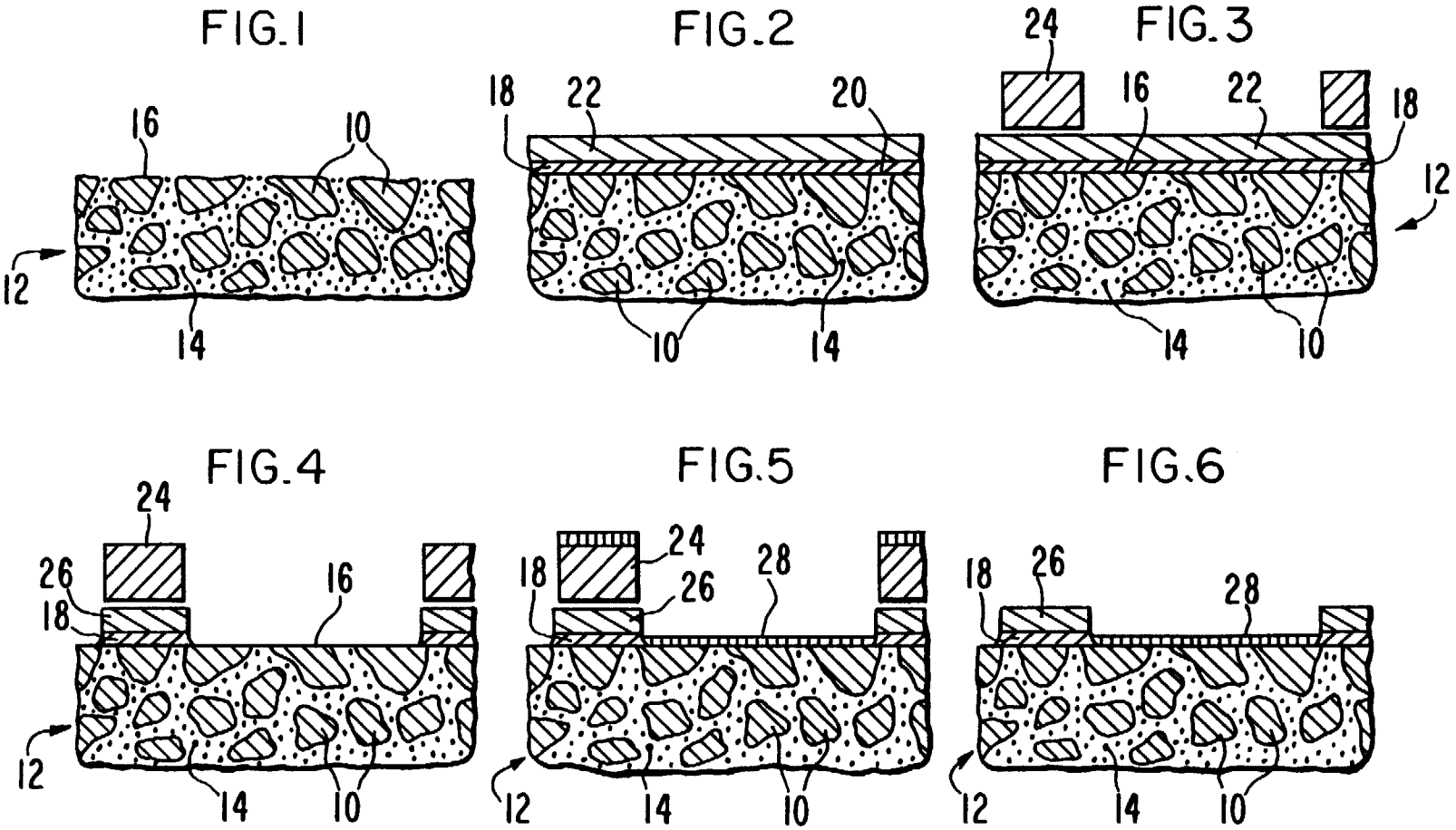
FIG. 1-FIG. 6 are cross-sectional sketches showing the steps in producing the inventive grid-cathode structure.

FIG. 1 is a section through a well-known impregnated cathode. The grain sizes are exaggerated for clairty. Grains 10 of tungsten or molybdenum are sintered into a porous matrix 12, machined to shape and impregnated with amolten alkaline-earth aluminate 14. The upper emissive surface 16 is smoothed by the machining.

FIG. 2 shows the result of the initial steps. For completeness, all the preferred elements are shown, although some may be omitted within the scope of the invention. A first, very thin continuous layer 18 of refractory metal such as tungsten or molybdenum, is deposited from vapor, as by sputter deposition, evaporation or by chemical vapor deposition, on emissive surface 16. Layer 18 seals over exposed areas 20 of impregnant, preventing them from reacting with or activating the later-applied non-emissive shadow grid layer 22 as of zirconium. Layer 22 is deposited from vapor on top of layer 18. It has appreciable thickness, such as 5 microns, to provide electrostatic focusing of electrons near the edges of the shadow grid elements.

FIG. 3 shows the next step. An apertured mask of grid elements 24, as of sheet molybdenum, covers the portions of layer 22 which are to become the elements of the completed shadow grid.

In FIG. 4 the deposited layers 18, 22 between mask elements 24 have been removed by bombardment, as by sputtering away in an inert gas such as argon, or by laser etch. Emissive layer 16 is thus exposed between non-emissive shadow-grid elements 26 which are protected from removal by mask elements 24. Initial surface 16 is thereby exposed in the emitting areas.

In FIG. 5 a final, activating layer 28 of a metal of the group consisting of osmium, iridium, rhenium and ruthenium or their alloys is vapor-deposited on the exposed surfaces. These metals are known to increase the emission of impregnated cathodes.

FIG. 6 shows the completed cathode 12 with bonded shadow grid 26 after removal of mask 24 so that only emitting portions 16 are activated.

Figure 7:
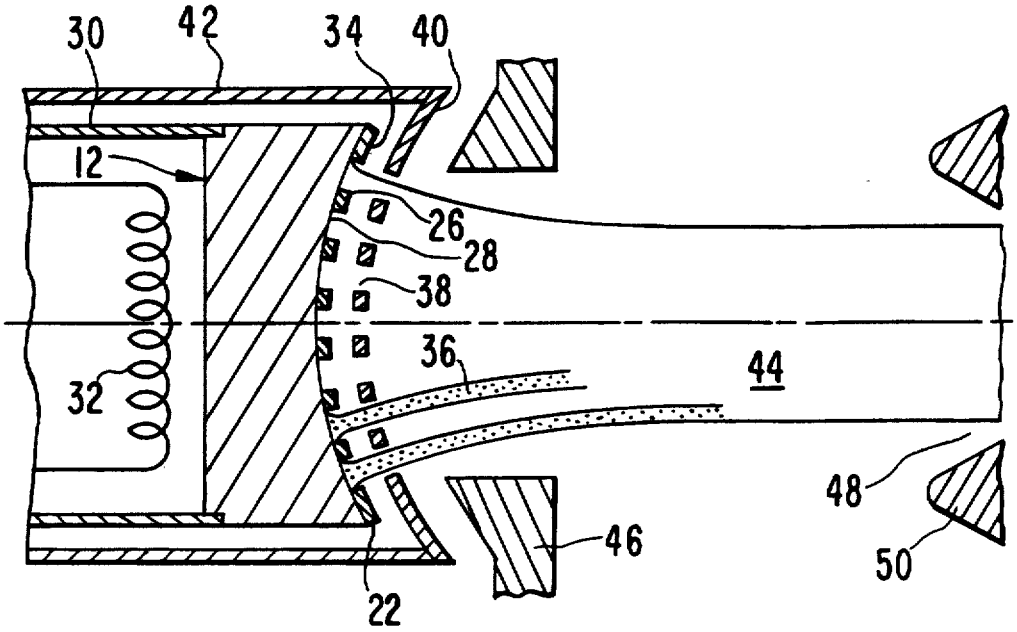
FIG. 7 is a schematic cross-section of an electron gun embodying the invention.

FIG. 7 is a schematic sketch of a grid-controlled electron gun embodying the invention. Cathode 12 is supported via a thin metallic tube 30 on the dielectric vacuum envelope (not shown, the structure is well-known). Cathode 12 is heated by a coil radiator 32. Covering the periphery of cathode 12, a continuous ring 34 of non-emissive layer 22 is left to stop stray emission from the edge, and an apertured mesh of raised shadow-grid elements 26 is bonded to cathode 12. Emission from active areas 28 is focussed into distinct beamlets 36 passing through apertures 38 in a metallic foil control grid 40 supported via metallic tube 42 from the dielectric envelope. The array of beamlets 36 forms a composite beam 44 which as a whole is focussed by a focus electrode 46 as is well known in the art. Focus electrode 46 is electrically connected either to cathode 12 or control grid 40. Beam 44 is drawn to and through an aperture 48 in an electrically isolated anode 50, whence it goes to an rf interaction structure (not shown).

Figure 8:
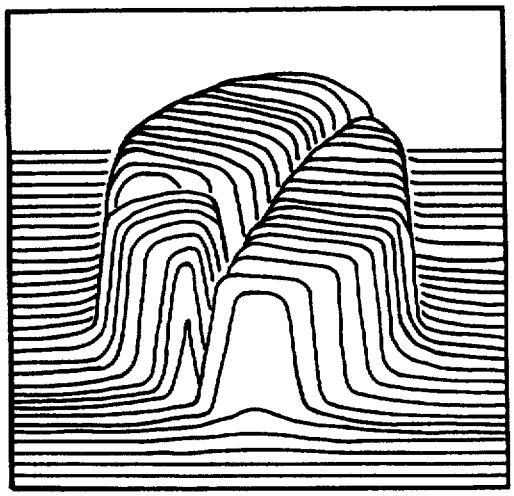
FIG. 8 is a composite perspective graph of current density in a test vehicle embodying the invention.

FIG. 8 shows the beamlet focussing in a test vehicle simulating part of the inventive electron gun. A small probe for current-density measurement was scanned across the beam (right and left) at progressive positions away from the cathode, shown in synthetic perspective by vertical displacements. A Y-shaped shadow-grid member embodying the invention was on the cathode surface, showing the unprecedented accuracy of separation of the beamlets.

We claim:

1. A process for making a cathode with integral shadow grid comprising the steps of:

(a) on a smooth, thermionically-emissive surface of a cathode body consisting of a porous matrix of refractory metal impregnated with an alkaline-earth aluminate, depositing from vapor a layer of conductive, non-emissive material, (b) placing a mask on the surface of said non-emissive layer, said mask comprising apertures separated by interconnected bars, (c) removing by bombardment through said mask the portions of said non-emissive layer between said bars, (d) removing said mask intact.

2. The process of claim 1 further including the steps of depositing from vapor a continuous layer of refractory metal on said emissive surface before depositing said non-emissive layer, and removing by bombardment the portions of said refractory metal layer between said bars.

3. The process of claim 2 wherein removing said portions of said non-emissive and refractory layers are done in the same process step.

4. The process of claim 1 including the further step of depositing from vapor, through said mask, onto the re-exposed portions of said emissive surface a layer of activating metal of the group consisting of osmium, iridium, rhenium and ruthenium and alloys thereof.

5. A process for making a cathode with integral shadow grid comprising the steps of:

(a) on a smooth, thermionically-emissive surface of a cathode body consisting of a porous matrix of refractory metal impregnated with an alkaline-earth aluminate, depositing from vapor a layer of conductive, non-emissive material, (b) placing a mask on the surface of said non-emissive layer, said mask comprising apertures separated by interconnected bars, (c) removing by bombardment through said mask the portions of said non-emissive layer between said bars, (d) depositing from vapor, through said mask, onto the re-exposed portions of said emissive surface a layer of activating metal of the group consisting of osmium, rhenium and ruthenium and alloys thereof and (e) removing said mask.

6. The process of claim 5 further comprising the step of depositing a continuous layer of refractory material on said emissive surface before depositing non-emissive layer and wherein said step of removing said portions of said non-emissive layer further comprises removing portions of said refractory layer in the same process step.

* * * * *